US007047703B2

(12) United States Patent
Waldrop

(10) Patent No.: US 7,047,703 B2
(45) Date of Patent: May 23, 2006

(54) METAL FRAMING STRUT WITH COILED END PORTIONS

(76) Inventor: Billy B. Waldrop, 7822 McCellan Blvd., Anniston, AL (US) 36206

( * ) Notice: Subject to any disclaimer, the term of this patent is extended or adjusted under 35 U.S.C. 154(b) by 11 days.

(21) Appl. No.: 10/418,690

(22) Filed: Apr. 18, 2003

(65) Prior Publication Data

US 2003/0188506 A1 Oct. 9, 2003

Related U.S. Application Data

(63) Continuation-in-part of application No. 09/874,093, filed on Jun. 4, 2001, now abandoned.

(51) Int. Cl.
*E04C 3/32* (2006.01)
*B21C 37/20* (2006.01)

(52) U.S. Cl. ..... 52/733.3; 52/739.1; 428/592

(58) Field of Classification Search ..... 52/639, 52/641, 656.1, 739.1, 733.3, 720.1, 93.1, 52/93, 93.2; 428/544, 597, 592, 595, 599, 428/603; 72/325, 370.03, 370.1, 370.11, 72/367.1, 369, 371, 326; 29/897.3
See application file for complete search history.

(56) References Cited

U.S. PATENT DOCUMENTS

| | | | | | |
|---|---|---|---|---|---|
| 653,000 | A | * | 7/1900 | Dundon | 52/739.1 |
| 902,666 | A | * | 11/1908 | Lepley | 249/184 |
| 1,229,365 | A | * | 6/1917 | Wiegand | 249/42 |
| 1,465,793 | A | * | 8/1923 | Schilling | 72/325 |
| 1,595,564 | A | * | 8/1926 | Neuhaus | 72/370.11 |
| 2,016,702 | A | * | 10/1935 | Bauer | 403/237 |
| 2,303,019 | A | * | 11/1942 | Burdorf | 72/369 |
| 2,658,241 | A | | 11/1953 | Houghton, Jr. et al. | 20/9 |
| 2,711,806 | A | | 6/1955 | Smith | 189/37 |
| 2,726,743 | A | | 12/1955 | Short et al. | 189/37 |
| 2,841,634 | A | | 7/1958 | Kimball | 174/45 |
| 3,039,731 | A | * | 6/1962 | Young | 52/632 |
| 3,078,970 | A | | 2/1963 | Black | 189/37 |
| 3,083,795 | A | | 4/1963 | Land | 189/34 |
| 3,088,562 | A | | 5/1963 | Jones et al. | 189/37 |
| 3,102,306 | A | | 9/1963 | Hutchinson | 20/9 |
| 3,124,223 | A | | 3/1964 | Kisovec | 139/37 |
| 3,196,996 | A | | 7/1965 | Rambelje | 189/36 |
| 3,247,639 | A | | 4/1966 | Rambelje | 52/632 |
| 3,282,001 | A | | 11/1966 | Bigalow | 52/111 |
| 3,506,295 | A | | 4/1970 | Yancey | 293/70 |
| 3,648,425 | A | | 3/1972 | Bolton | 52/632 |

(Continued)

FOREIGN PATENT DOCUMENTS

| | | | | |
|---|---|---|---|---|
| DE | 2931131 | * | 2/1981 | 52/739.1 |

(Continued)

*Primary Examiner*—Michael Safavi
(74) *Attorney, Agent, or Firm*—Gene Scott & Patent; Law & Venture Group

(57) ABSTRACT

A building strut is formed as a cylinder having a plurality of contiguous sidewalls. Opposing terminal ends of the sidewalls define the ends of the cylinder. One or more of the sidewall ends are formed as a coiled spiral. These spirals may be formed within one of the ends of the cylinder or lateral to the cylinder's end and thus provide extreme strength to the end of the cylinder. The ends of the sidewalls that are not coiled may terminate adjacent to the coiled sidewall or may extend axially beyond it, and they may be separated to form independent ears, or they may maintain their mutual integrity. If the ears are separate, they may be bent outwardly lateral to the cylinder, or at an angle to it, to facilitate joining to other structural members.

10 Claims, 2 Drawing Sheets

U.S. PATENT DOCUMENTS 3,779,591 A * 12/1973 Rands ..... 293/133
3,873,221 A * 3/1975 Greenfield ..... 52/697
3,897,668 A 8/1975 McDonnell ..... 52/632
3,972,510 A * 8/1976 Dougherty ..... 256/11
4,397,127 A 8/1983 Mieyal ..... 52/241
4,413,361 A * 11/1983 Wolf et al. ..... 4/506
4,621,421 A * 11/1986 O'Loughlin ..... 72/370.1
4,852,251 A * 8/1989 Boucher ..... 72/325
4,910,939 A * 3/1990 Cavanagh ..... 52/648.1
4,944,123 A 7/1990 Larrieu ..... 52/127.2
5,228,251 A 7/1993 Frigon ..... 52/111
5,310,163 A * 5/1994 Waite ..... 72/367.1
6,279,288 B1 * 8/2001 Keil ..... 52/656.1
6,964,096 B1 * 11/2005 Tryland ..... 72/370.11

FOREIGN PATENT DOCUMENTS

SE 469472 * 4/1969 ..... 52/656.1

* cited by examiner

METAL FRAMING STRUT WITH COILED END PORTIONS

RELATED APPLICATIONS

This is a continuation-in-part application of a prior filed and application having Ser. No. 09/874,093 and file date of Jun. 4, 2001 now abandoned.

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to structural elements in the building construction industry, and more particularly to a framing strut apparatus with coiled ends.

2. Description of Related Art

The following art defines the present state of this field:

Houghton, Jr., et al., U.S. Pat. No. 2,658,241 describes a bridging unit comprising a pair of telescopically adjustable bars of substantially U-shaped cross-section. The female bar includes a longitudinal guide rib in its bight portion and further including longitudinally spaced, outwardly pressed substantially louver-shaped projections defining depressions in its opposed side walls spaced from the free longitudinal edges thereof. The female bar still further having channels in the side walls extending from the depressions to said longitudinal edges, substantially louver-shaped dogs struck out from the side walls of the male section and engageable selectively in and disengageable from the depressions through the channels for releaseably securing the bars in adjusted position. The male section having a longitudinal groove in its bight portions slidably accommodating the rib, and guides struck inwardly from the side walls of the female bar adjacent one end thereof and engaged with the longitudinal edges of the male bar for slidably securing same in the one end of the female bar.

Smith, U.S. Pat. No. 2,711,806 describes an expandable supporting beam for use in building, comprising a plurality of telescopic member including a central member and two end members, each end member having an opening adjacent the outermost end thereof, a bearing portion on each of the end members for respective mounting on spaced supports, means for removing the bearing portions from the supports and including dismounting bars, each bar being provided with a recess facing a corresponding opening; the bars being mounted for longitudinal sliding movement in the outer ends of the end members and movable between inoperative positions within the members and operative positions extending beyond the ends of the end members to abut the supports on which the members bear to force the respective bearing portions from the supports, and means extending through an opening in one of the end members into a recess in one of the bars for moving each of the dismounter bars between the positions.

Short et al., U.S. Pat. No. 2,726,743 describes a girder comprising a pair of open-web I-beams, means, at longitudinally spaced stations connecting adjacent flange edges of the beam in a manner to secure the beams in spaced parallel relationship defining a continuous passageway therebetween, bounded on its sides by the respective webs of the beams and on its top and bottom by the respective adjacent upper and lower flanges of said beams and said connecting means, said adjacent flanges at the bottom of the passageway defining a pair of spaced tracks there along, the adjacent parallel flanges at the top of the passageway defining a pair of tracks there along opposed to the lower tracks, a second pair of open-web I-beams of lesser height and width than said passageway in said first pair of I-beams, means securing the second pair of I-beams in parallel relationship at the adjacent corresponding edges of their upper and lower flanges, the second pair of I-beams being retractable and extensible in the passageway defined by said first pair of I-beams, opposed anti-friction roller means between the first and second pair of I-beams, engageable along the upper and lower pairs of tracks respectively for centering the second pair of I-beams within the first pair of I-beams, and for facilitating longitudinal telescoping movement of said first and second pairs of I-beams, the roller means comprising transverse bearing sleeves welded to the web of the second beam in alignment, and axle extending through said sleeves, and individual rollers on said axle outwardly of the web of the second pair of I-beams in engagement with the flange of the first pair of I-beams, and other of the individual rollers inwardly of the webs of the second pair of I-beams in engagement with the flanges of the second pair of I-beams.

Kimball, U.S. Pat. No. 2,841,634 describes a tubular pole that comprises a plurality of nonmetallic telescopic sections and with the sections of the pole being of substantially identical diameter for the major height of the pole, a metallic conductor embedded within each of the sections and with the conductors having outwardly and inwardly exposed portions whereby the conductors of adjacent sections have in overlying frictional contact when the sections are in telescoped relation to form a continuous electrical conductor throughout the height of the pole, the conductors lying wholly within the pole against external exposure when the sections are assembled.

Young, U.S. Pat. No. 3,039,731 describes an extensible column for supporting an overhead roof structure relative to a floor slab or the like comprising, a pair of load-bearing tubes each having a relatively thin cylindrical wall, cross members joining said tubes rigidly in spaced parallel relationship, an extensible stud having a relatively thin cylindrical wall telescopically interfitting an endwise portion of each load-bearing tube, each stud having a portion projecting outwardly beyond the end of said load-bearing tube, an endwise portion of the stud being flattened and providing an anchor plate projecting from the end portion of the stud at right angles to the axis thereof, the anchor plate being integral with the cylindrical wall of the stud, the anchor plate having fold portions integral with the end of the cylindrical wall of the stud and doubled over upon the anchor plate, the fold portions extending outwardly and joined to the outer edges of the anchor plate at opposite sides, the fold portion providing a rigid connection adapting the anchor plate to resist angular deflection relative to the stud, the end portion of each,load-bearing tube opposite the stud having an anchor plate projecting therefrom at right angles to the axis of the load-bearing tube, the column adapted to be interfitted in upright position between the floor slab and roof structure with the studs extended and with the anchor plates seated against the floor slab and roof structure, and means for locking the extensible studs relative to the load-bearing tubes, thereby adapting the column to carry the weight load of the roof structure.

Black, U.S. Pat. No. 3,078,970 describes a section of a sectional adjustable truss-type bridge joist, a prefabricated section comprising, in combination, a linearly straight upper angle iron, a complemental linearly straight lower angle iron parallel to and spaced below the upper angle iron, the angle irons being of duplicate cross-section and each including a vertical flange and a horizontal flange, the vertical flanges being in a common plane, the corresponding inner ends of the upper and lower angle irons terminating together a flat-faced plate of a cross-sectional thickness corresponding to the thickness of the vertical flanges of the angle irons and interposed between and welded to the cooperative lengthwise edges of the flanges, and a vertical longitudinal edge of the plate being flush with the cooperating terminal ends of the vertical flanges, the vertical flanges having several bolt holes cooperating with the transverse end portions of the plate, the end of the upper angle iron opposite to the locale of the plate extending beyond the corresponding end of the lower angle iron and being provided with L-shaped fixedly attached cleats, the cleats providing bearing seats, and diagonal braces connecting the upper and lower angle irons together.

Land, U.S. Pat. No. 3,083,795 describes a building wall comprising first channel means secured to the building ceiling and having downwardly depending spaced apart substantially parallel flanges, second channel means secured to the building floor and having upwardly extending spaced apart substantially parallel flanges, the first channel means being disposed in cooperative relation to the second channel means, a plurality of tubular support elements interposed between the first and second channel means in horizontally spaced generally parallel relation, the ends of the support elements being disposed between the flanges of the first and second channel means, each support element comprising an elongated element into at least one end of which an extension element is mounted in axially adjustable threaded relation, an outer surface of each elongated element being in substantial alignment with the outer surface of one flange of the first channel means and with the outer surface of the corresponding flange of the second channel means, a spacer block threadedly mounted on at least one of the extension elements and normally disposed approximately midway between the one end of the associated elongated element and the associated channel means, the spacer block having an outer surface in substantial alignment with the outer aligned surfaces of the associated elongated element and flanges wall panel means disposed adjacent the vertically aligned surface of said spacer block, flanges, and tubular supports in flat abutting face contacting relation and means for securing the wall panel means to the adjacent aligned surfaces of the flanges, spacer block, and tubular supports.

Jones et al., U.S. Pat. No. 3,088,562 describes an extensible and contractible joist comprising an outer joist member and an inner joist member disposed in telescopic relationship to each other, the outer joist member comprising a top frame, a bottom frame and side frame members defining a hollow frame construction, the inner joist member having a top member, side members and terminating at its bottom in a lateral projection, the inner joist member being of a height less than the spacing between the top and bottom frames of the outer joist member, but the top frame of the outer joist member and the extended portion of the top member of the inner joist member defining a generally continuous unobstructed horizontal load bearing surface, overhanging projection means carried by the bottom frame of the outer joist member at an end thereof, the overhanging projection means overhanging the lateral projection of the inner joist member permitting slidable movement of the inner joist member relative to the outer joist member but restricting upward movement of the inner joist member within the outer joist member to space the top member of the inner joist member a short distance below the top frame of the outer joist member, and a plate carried by the bottom frame of the outer joist member adjacent the overhanging projection means restricting downward movement of the inner joist member within the outer joist member to maintain the top member of the inner joist member in substantially plane-parallel spaced relationship to the top frame of the outer joist member, thereby to cause the inner joist member in use to be loaded in tension at the juncture of the inner joist member with the end of the outer joist member and to prevent the application of crushing force from the outer joist member to the top frame member of the inner joist member.

Hutchinson, U.S. Pat. No. 3,102,306 describes a method of forming a pair of separably connected cooperating bracing members comprising cutting out a pair of transverse diametrically opposed slots from a long flat strip of metal intermediate the ends thereof and leaving a narrow tongue separating the slots, the slots communicating with the sides of the strip, the slots communicating with the sides of the strip, the slots dividing the strip into first and second end portions which are connected by the tongue, forming at least one opening in the first end portion substantially midway between the sides thereof capable of receiving the tongue, forming the outer end of the strip into wood penetrating elements, forming longitudinally extending rib adjacent one side of the first end portion, forming a longitudinally extending rib on the second end portion adjacent the same side of the strip as the first mentioned rib, the ribs being in parallel relationship and lying on opposite sides of and immediately adjacent to a common longitudinally extending line, the ribs protruding from opposite faces of the strip for subsequent engagement with each other, transversely scoring the strip along the line of juncture between the tongue and first end portion whereby the tongue can be severed from the first end portion by pivotally moving the end portions relative to one another about the weak joint, forming the first end portion into a first channel whereby its rib is located on the side wall of the channel and forming the second end portion into a second channel which is slightly narrower than the first named channel whereby the second channel can be telescopically seated in the first channel and enclosed thereby, and whereby the second named rib is located on the side wall of the second channel corresponding to the side wall of the first channel upon which its rib is located, the first named rib being closer to the side edge of the strip than the second named rib whereby the first named rib lies below and engages the second named rib when the channels are in the telescoped relationship.

Kisovec, U.S. Pat. No. 3,124,223 describes an adjustable framework member consisting of at least two longitudinally extended parts including an outer carrier having a lower edge, an upper edge and side walls which connect the lower edge and the upper edge, and inner carrier telescopically received in said outer carrier with vertical clearance between the two carriers, adjustable locking means disposed inwardly of the end of the outer carrier for displacing the inner end of the inner carrier upwardly with respect to the outer carrier, and inwardly projecting fulcrum means located below the lower surface of the upper edge of the outer carrier at a point which lies outwardly of the locking means.

Rambelje, U.S. Pat. No. 3,196,996 describes a form supporting girder comprising an end support piece disposed at the ends thereof and having a load supporting support flange extending longitudinally from the end at the uppermost point thereof, the invention comprising a bearing rib transversely arranged at the mid-portion of the end face of said piece, the rib extending outwardly from the face a distance approximating the room necessary for pinch bar insertion and having an enlarged end portion, a bearing ridge downwardly extending from the bottom of the flange and having a bearing face aligned with the enlarged end portion of the bearing rib.

Rambelje, U.S. Pat. No. 3,247,639 describes and adjustable cambered form-supporting girder for concrete construction comprising a box-like section and an I-beam section slidable lengthwise within the box-like section for adjustment of the length of the girder, locking means for holding an outer end surface of the I-beam section pressed against an inner surface of the box-like section, the box-like section being constructed of a single extruded member having opposed side walls and upper and lower walls extending between the side walls, and at least one flange extending lengthwise of the box-like section and projecting upwardly above the upper wall, the upwardly projecting flange being higher toward the center of the box-like section than toward the ends thereof to produce a camber in the uppermost surface of the box-like section without cambering such section as a whole.

Bigalow, U.S. Pat. No. 3,282,001 describes a vertical column and a base supporting the column, the base comprising a flat stationary plate, a cover having an opening, means fixing the cover to the plate in spaced relation there above, and a flat adjustable plate supported on the stationary plate in the space between it and the cover, the column being fixed to the adjustable plate and extending through the opening, the opening being larger than the cross-sectional dimensions of the column to enable adjustment of the adjustable plate with respect to the stationary plate to rotate the column and shift it horizontally in any direction, but smaller than the adjustable plate, whereby the cover retains the adjustable plate, the column remaining vertical throughout adjustments of the adjustable plate.

Demeules et al., U.S. Pat. No. 3,325,957 describes an extensible joist comprising in combination: a main joist assembly composed of a pair of longitudinally extended laterally spaced elongated members, each elongated member having an outwardly directed flange and a downwardly directed flange, a brace means including an elongated element having alternate upward and downward right angle bends, the elongated element having alternate right angle bends located between and secured to the downwardly directed flanges to divide the element into plurality of segments, a longitudinally extended stress member positioned below the members and secured to the brace means, and end piece having a generally U-shaped configuration mounted on one end of the joist assembly for longitudinal sliding movement thereon, the end piece comprising a pair of end piece members positioned adjacent the outside of one end of the downwardly directed flange of the elongated member at the outer end thereof and a cross member connecting the outer ends of the end piece members, each end piece member having an elongated top surface engageable with the bottom surface of the adjacent outwardly directed flange of the elongated member and a side engageable with the outside of the adjacent downwardly directed flange, the end piece members including opposed and aligned longitudinally extended openings, and adjustable and releasable fastening means extended through the openings between adjacent segments of said brace means releaseably clamping the sides of the end piece members into engagement with the downwardly directed flanges, a single retaining means connected to the elongated members longitudinally inwardly from the one end of the joist assembly and extended downwardly therefrom between the end piece members, the retaining means having a portion engaging the bottom of the end piece members and holding the top surfaces of the end piece members in engagement with the bottom surfaces of the downwardly directed flanges Yancey, U.S. Pat. No. 3,506,295 describes a bumper comprising: an impact absorbing sheet having at least two vertically spaced rows of openings, a horizontally extending ribbon portion being provided on each side of the rows of openings and the openings in each row being separated by a web portion, each ribbon including alternating, longitudinally spaced crests and troughs, the crests extending outwardly from a vertical reference plane and the troughs extending inwardly from the reference plane, the transitional portion of each ribbon between the crests and troughs extending at an angle with respect to the reference plane, the crests on each ribbon being aligned with a trough on an adjacent ribbon whereby the aligned transitional portions of adjacent ribbons are disposed at angles that are inclined oppositely with respect to said reference plane, said webs each having a first end portion merging with a transitional portion of one ribbon and a second end portion merging with the aligned transitional portion of an adjacent ribbon, the intermediate portion of each web between its end portions being twisted throughout its length; and means for mounting said sheet upon a vehicle.

Bolton, U.S. Pat. No. 3,648,425 describes a device including threadably engaged telescoping members adapted to be extended into engagement with spaced apart nonmetallic floor joists. One end of the device has two pointed projections for penetrating a joist and limiting the member from rotating while the other end has a single pointed projection for penetrating a joist but permitting the member to be rotated to extend the device.

McDonnell, U.S. Pat. No. 3,897,668 describes a spring-loaded, adjustable stud, for a wall partition arrangement, adapted to fit between a pair of channel members secured to a floor and ceiling, comprising; a pair of channel elements arranged in telescoping relation, and having spring means interconnecting said channel elements and urging them away from each other and against said channel members.

Mieyal, U.S. Pat. No. 4,397,127 describes a metal stud assembly disclosing for use in either drywall construction or as intermediate studs in demountable walls. The stud assembly includes a U-shaped stud member and a U-shaped stud extension which telescopes into one end of the stud member with a resilient-type of interference fit which produces a controlled resistance to relative axial movement and eliminates possible looseness. The stud extension is provided with angulated tabs which snap into a channel-shaped ceiling track to lock the stud extension therein. The lower end of the stud fits into a channel-shaped floor track to secure the lower end of the stud assembly in place. The stud assembly is sufficiently flexible to allow the lower end to be twisted through about 90 degree to position the narrow dimension thereof crosswise with respect to the floor track for easy insertion. After insertion, the stud assembly is returned to the untwisted position to complete the installation.

Larrieu, U.S. Pat. No. 4,944,123 describes an elongated stiff but flexive and longitudinally bowable inclined push stick including an upper end engageable with the top plate of a wall frame and equipped with subfloor surface engaging and penetrating teeth on its lower end. The upper end of push stick is engageable with the top plate of a first wall frame adjacent a second relatively angulated wall frame relative to which the first wall frame is anchored and the teeth on the lower end of the push stick are engaged with the subflooring. Thereafter, the longitudinal mid portion of the push stick has downward inclined pressure applied thereto toward the sole plate of the first wall frame while the upper end of the push stick is maintained in engagement with top plate of the first wall frame in order to slide the teeth of the lower end of the push stick along the subflooring until the first wall frame is vertically disposed after which the downward pressure on the longitudinal mid portion of the push stick may be released and inclined brace of the second wall frame may be secured in position.

Frigon, U.S. Pat. No. 5,228,251 describes An extendable pole or mast is constructed from a plurality of nested pole sections with each pole section is made from an initially flat sheet which is roll formed into a rectangular, preferably square, cross section element. A seam is formed by over lapping the edges of the sheet, with the bulk of the seam being placed inwardly of the element. Each of the inner sections includes its own seam and an offset of sufficient size and depth to receive the seam and offset of outer sections. The sheet material permits tabs to be cut or stamped into outer walls of the outer sections in order to support an adjacent inner pole section. Tabs are formed in each of the outer pole sections. These tabs are biased to extend inwardly, against the adjacent inner pole section. Tabs may be formed below the first tab to provide a choice in the amount of extension of the pole.

Keil, U.S. Pat. No. 6,279,288 describes a rigid tubular member of variable length and rectangular cross-section adapted to be sized, flared and conjoined with at least one other rigid member to create a variety of tubular member frameworks for greenhouse construction, and the like. Each member is provided with a plurality of elongate, linear groovings, either located proximal to, or coincident with, the external and/or internal elongate seams of the member, with the inscribed sets of groovings are such being of a depth sufficient to facilitate separation under manual force of at least one, up to four, of the end sidewall segments, providing flared end segments, either disposed at right or acute angles, which segments are adapted to be fastened to another rigid member in any of several locations, along it, in the course of a framework erection.

Muller et al., EP 0625622, describes an extensible structural support having an inner tube which is plugged telescopically into an outer tube and is provided in the longitudinal direction with a plurality of bores for receiving a plug-in bolt which is intended for the length adjustment of the structural support and, in the event of loading of the structural support, is supported on the outer tube. According to the invention, adjacent bores of the inner tube are arranged such that they are offset, in the circumferential direction of the inner tube, by a predetermined angular amount in each case. By virtue of the bores being arranged such that they are offset at certain angles, the invention makes it possible, for a structural support with a predetermined nominal load-bearing capacity and with a spacing between adjacent bores of the inner tube which is the same as in the prior art, to reduce the wall thickness and/or the diameter of the inner tube considerably, as a result of which savings in materials and thus weight can be made for the structural support, this having considerable advantages in terms of costs, in particular as far as the mass production of such structural supports is concerned.

Engelburg, NR 469472, no English translation.

The prior art teaches the use of tubular building struts, but does not teach coiling of the ends of the sidewalls of these struts to achieve significant strength improvements. The present invention fulfills these needs and provides further related advantages as described in the following summary.

SUMMARY OF THE INVENTION

The present invention teaches certain benefits in construction and use which give rise to the objectives described below.

The invention is a building strut formed as a cylinder and having a plurality of contiguous sidewalls. Opposing terminal ends of the sidewalls define the ends of the cylinder. One or more of the sidewall ends are formed as a coiled spiral. These spirals may be formed within one of the ends of the cylinder or lateral to the cylinder's end and thus provide extreme strength to the end of the cylinder. The ends of the sidewalls that are not coiled may terminate adjacent to the coiled sidewall or may extend axially beyond it, and they may be separated to form independent ears, or they may maintain their mutual integrity. If the ears are separate, they may be bent outwardly lateral to the cylinder, or at an angle to it, to facilitate joining to other structural members.

A primary objective of the present invention is to provide a metal framing strut having advantages not taught by the prior art.

Another objective is to provide such a strut having greatly improved strength at its ends.

Other features and advantages of the present invention will become apparent from the following, more detailed description, taken in conjunction with the accompanying drawings, which illustrate, by way of example, the principles of the invention.

BRIEF DESCRIPTION OF THE DRAWINGS

The accompanying drawings illustrate in perspective view one end of the present invention strut wherein in.

DETAILED DESCRIPTION OF THE INVENTION

Figure 1:
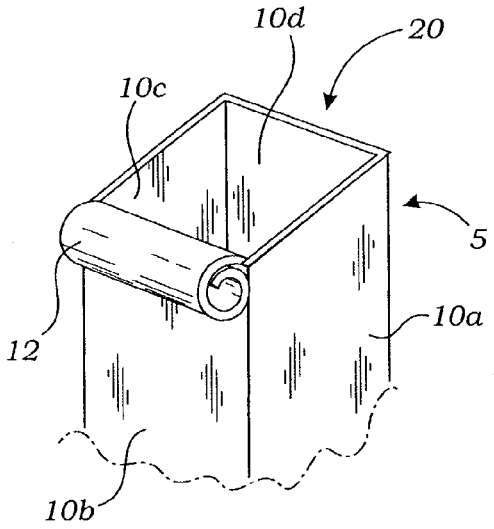
FIG. 1 one sidewall terminates with an external coil.

The above-described drawing FIGS. 1–4 illustrate the invention, a strut apparatus for constructive use in the building framing arts.

The drawing figures show a portion of a cylindrical strut having square or rectangular shape in cross-section. However, the cylindrical strut of this invention may have three, four, five or more sides forming a polygon in cross-section. The four-sided cylinder shown in the figures is fully representative of these other polygonal shapes and will be used here to teach the principals of the invention. The instant strut is made of sheet metal and may be formed integrally or bent and welded as is well known in the field of this invention.

The strut is used as a structural member in building construction. It is important to the invention that the ends of the strut be attached to other building members and for this purpose, the ends of the strut are reinforced in a novel manner as will be taught in the following description and in the figures. It should be realized that the figures show only one end of the strut of this invention, and this illustration is representative of both ends of the strut, realizing that both ends of any one strut do not necessarily have to be identical, i.e., each end of any strut made in accordance with the instant invention may be formed uniquely in accordance with the various modes and enablements described herein. The strut may be straight and linear in form, or it may be bent or curved in accordance with construction needs.

Figure 2:
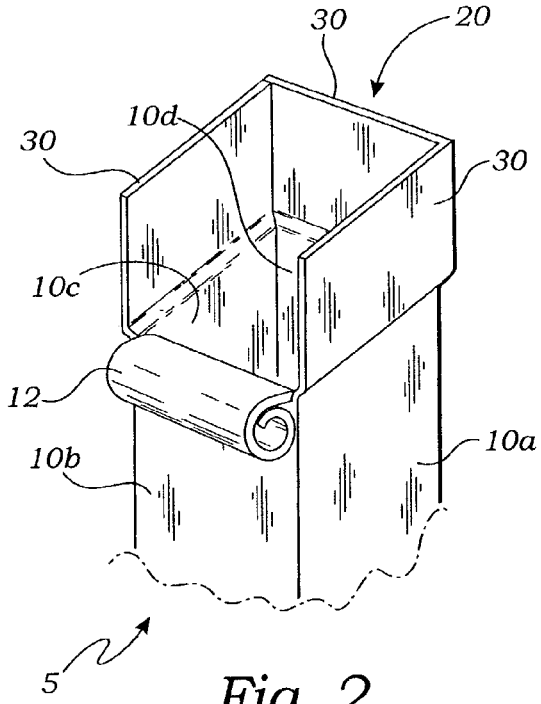
FIG. 2 one sidewall terminates with an external coil, the non-coiled sidewalls extending beyond the coil and not separated into individual ears.
Figure 3:
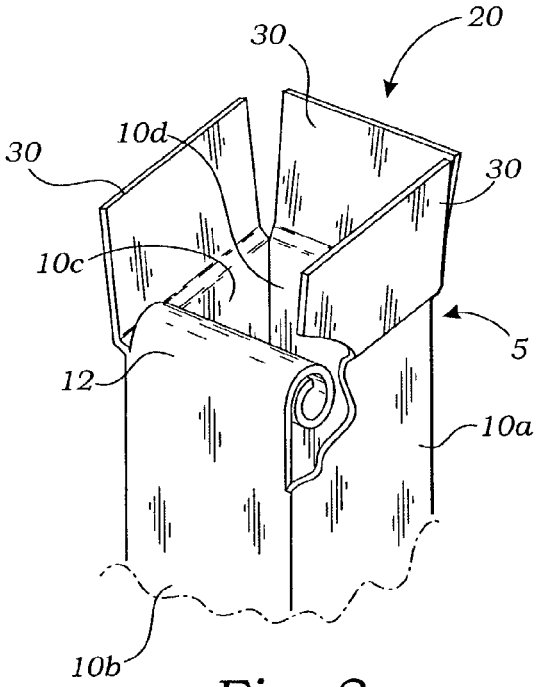
FIG. 3 one sidewall terminates with an internal coil, the non-coiled sidewalls extending beyond the coil and separated into individual ears.
Figure 4:
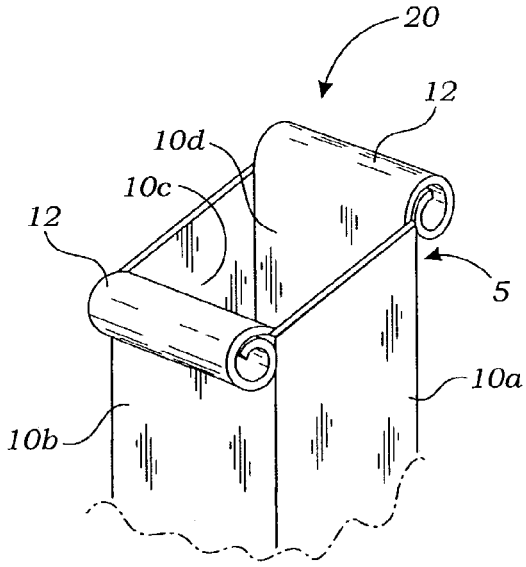
FIG. 4 two sidewalls terminate with external coils.
Figure 5:
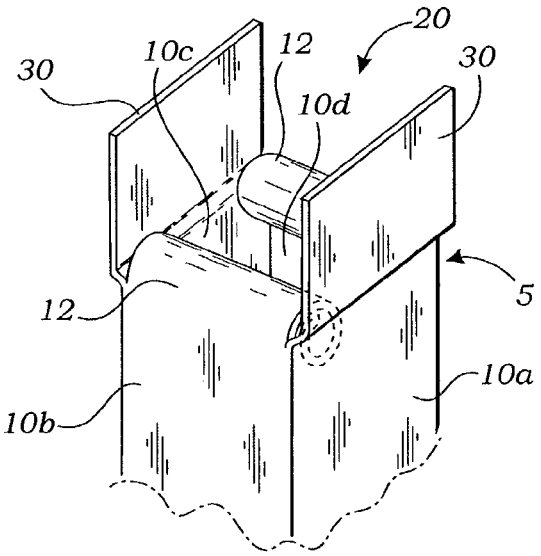
FIG. 5 two sidewalls terminate with internal coils, the non-coiled sidewalls extending beyond the coils.
Figure 6:
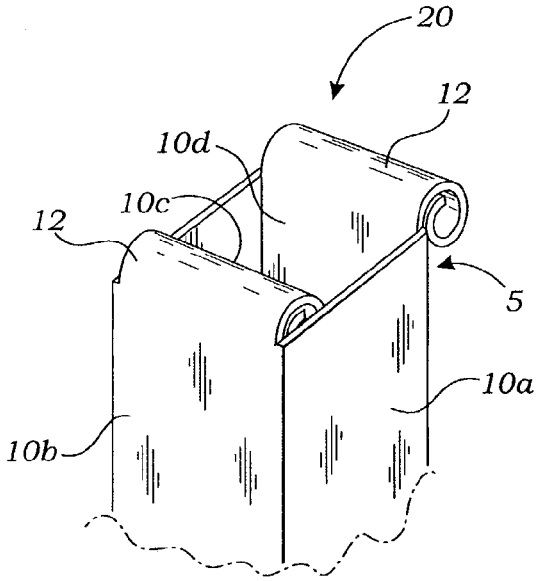
FIG. 6 one sidewall terminates with an external coil, a second sidewall terminates with an internal coil.
Figure 7:
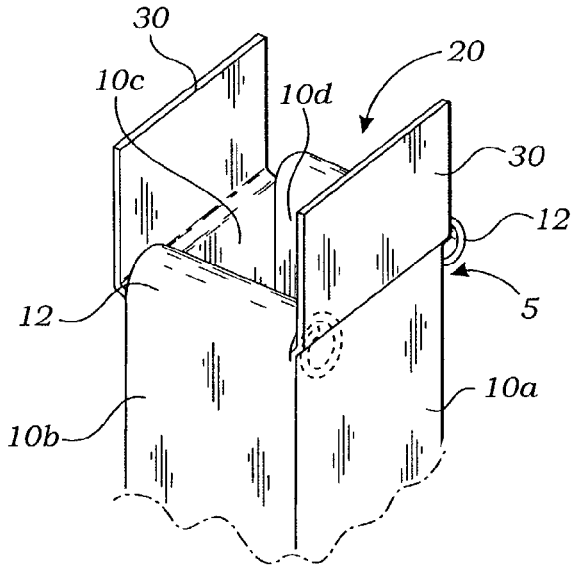
FIG. 7 one sidewall terminates with an external coil, a second sidewall terminates with an internal sidewall, the non-coiled sidewalls extending beyond the coils.

The invention is a building strut apparatus comprising a cylinder 5 having a plurality of contiguous sidewalls 10*a*, 10*b*, 10*c* and 10*d* in the preferred embodiment and represented in the general sense by the numeral 10. The strut has opposing terminal ends 20. The ends of the sidewalls define the cylinder's end 20. Preferably, at least one of the terminal ends of the sidewalls 10 is formed into the shape of a coiled spiral 12, and this coiled spiral 12, in each instance, may be formed so as to lay laterally, externally or exteriorly, to one of the ends 20 of the cylinder, as shown in FIG. 1, or alternately, may be formed so as to lay within the cylinder's open end 20, as shown in FIG. 3. It should be noted that the coil 12 is indeed a spiral with at least one generally circular rotation of the sheet metal of the end of the sidewall 10, and preferably more than one rotation of the sheet metal as shown in FIG. 2. This coil is placed adjacent to, or actually touching the sidewall 10 from which it is derived. This is clearly shown in the figures.

The non-coiled ends of the other sidewalls 10 may terminate adjacent to the coil 12, as shown in FIG. 1, or the other sidewalls 10 may extend axially beyond the coil 12, as shown in FIG. 2. Clearly, one or more of the sidewalls may extend or not in accordance with the needs for attachment of the strut. This is to say, that each sidewall 10 may extend or not independently of the other sidewalls at a common end of the strut.

When the sidewalls do extend beyond the coil 12, they may be maintained in integral form, as shown in FIG. 2, or they may be separated into individual tabs or ears, as shown in FIG. 3.

In the other figures we see that more than one of the sidewalls 10 may be formed into an internal or an external coil 12. Embodiments of the present invention may include one, two, three, four or more of the sidewalls formed into coils 12. FIGS. 4–7 illustrate plural coils 12 formed at one end 20 of strut 5, and with such coils 12 placed internally, externally or a combination, and with the non-coiled sidewalls either separated into individual ears or tabs 30, or not. As is known in the art, the individual ears may extend axially, or may be bent outwardly lateral to the cylinder, or at an angle to it, to facilitate joining the strut to other structural members of a construction.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A building strut apparatus comprising a tubular member having a plurality of contiguous flat sidewalls arranged as a rectangle, opposing terminal ends of the sidewalls defining ends of the tubular member; wherein at least one of the terminal ends of one of the sidewalls is formed as a coiled spiral of greater than one circular rotation in contact with the sidewall adjacent thereto.

2. The apparatus of claim 1 wherein the at least one coiled spiral is positioned in one of: (a) within one of the ends of the tubular member and (b) outside one of the ends of the tubular member.

3. The apparatus of claim 2 wherein none of the terminal ends of the sidewalls extends axially beyond the at least one coiled spiral.

4. The apparatus of claim 2 wherein the at least one of the terminal ends of the sidewalls extends axially beyond the at least one coiled spiral.

5. The apparatus of claim 4 wherein the terminal ends of the sidewalls are separated into individual ears.

6. A building strut apparatus comprising a tubular member having a plurality of contiguous flat sidewalls arranged as a rectangle, opposing terminal ends of the sidewalls defining ends of the tubular member; wherein at least one of the terminal ends of each of at least two of the sidewalls are each formed as a coiled spiral of greater than one circular rotation in contact with the sidewall adjacent thereto.

7. The apparatus of claim 6 wherein each one of the coiled spirals is positioned in one of: (a) within one of the ends of the tubular member and (b) outside one of the ends of the tubular member.

8. The apparatus of claim 6 wherein none of the terminal ends of the sidewalls extends axially beyond the coiled spirals.

9. The apparatus of claim 6 wherein the at least one of the terminal ends of the sidewalls extends axially beyond the coiled spirals.

10. The apparatus of claim 9 wherein the terminal ends of the sidewalls are separated into individual ears.

* * * * *